US007368676B2

(12) United States Patent
Mattlar et al.

(10) Patent No.: US 7,368,676 B2
(45) Date of Patent: May 6, 2008

(54) SWITCHING DEVICE

(75) Inventors: Harri Mattlar, Iskmo (FI); Aki Suutarinen, Vaasa (FI); Rainer Kolmonen, Laihia (FI)

(73) Assignee: ABB Oy, Helsinki (FI)

( * ) Notice: Subject to any disclaimer, the term of this patent is extended or adjusted under 35 U.S.C. 154(b) by 0 days.

(21) Appl. No.: 10/587,360

(22) PCT Filed: Feb. 2, 2005

(86) PCT No.: PCT/FI2005/000070

§ 371 (c)(1),
(2), (4) Date: Jul. 26, 2006

(87) PCT Pub. No.: WO2005/076302

PCT Pub. Date: Aug. 18, 2005

(65) Prior Publication Data

US 2007/0131528 A1 Jun. 14, 2007

(30) Foreign Application Priority Data

Feb. 3, 2004 (FI) ..... 20045026

(51) Int. Cl.
*H01H 5/00* (2006.01)

(52) U.S. Cl. ..... 200/400

(58) Field of Classification Search ..... 200/11 R, 200/11 J, 17 R, 400–402, 405, 410, 414, 200/416, 440, 442, 445, 446, 449, 450, 453, 200/457–459, 462, 463, 467
See application file for complete search history.

(56) References Cited

U.S. PATENT DOCUMENTS 4,020,301 A 4/1977 Ericson et al.
4,622,443 A * 11/1986 Mooz ..... 200/50.01
4,743,715 A 5/1988 Gerbert-Gaillard et al.
6,031,192 A 2/2000 Liebetruth
6,492,606 B1 * 12/2002 MacLean ..... 200/400
6,940,032 B2 * 9/2005 Sirajtheen et al. ..... 200/400
7,019,228 B2 * 3/2006 Anger et al. ..... 200/50.01
2002/0079995 A1 6/2002 Yang

FOREIGN PATENT DOCUMENTS

EP 1 353 349 A2 10/2003

OTHER PUBLICATIONS

International Search Report dated Jun. 7, 2005.
Written Opinion of the International Searching Authority dated Jun. 7, 2005.
Finland Search Report (with English translation of category of cited documents) dated Dec. 1, 2004.

* cited by examiner

*Primary Examiner*—Michael A. Friedhofer
(74) *Attorney, Agent, or Firm*—Buchanan Ingersoll & Rooney PC

(57) ABSTRACT

A switching device having a frame, in which an actuator adapted to rotate a main shaft of the switching device and rotatable around an axis of rotation, the actuator having a 0 position, an I position and a first dead point between the 0 position and the I position, the I position being located by a given angle ($\alpha_6$) in a first direction relative to the 0 position. The actuator also has a testing position, the testing position being located by a predetermined angle ($\beta_6$) in a second direction relative to the 0 position, the second direction being opposite relative to the first direction.

20 Claims, 6 Drawing Sheets

SWITCHING DEVICE

BACKGROUND OF THE INVENTION

The invention relates to a switching device according to the preamble of the independent claim.

Switching devices are instruments employed for opening and closing an electric circuit. The switching device comprises at least one pole and a control device adapted to open and close said pole. Switching devices include switches and switch-fuses, for example.

Switching devices have a 0 position, wherein the poles of the switching device are open, and an I position, wherein the poles of the switching device are closed. The positions of the poles of the switching device are changed by rotating the main shaft of the switching device. For rotating the main shaft, switching devices are provided with an actuator having a 0 position and an I position, which correspond to the 0 position and I position of the switching device.

Some switching devices also have a testing position, wherein the poles of the switching device are open, but the position of the auxiliary contacts corresponds to the I position of the switching device.

The problem in known switching devices is to accomplish the testing position. In some known switching devices, separate lever mechanisms are used to accomplish the testing position, but such an assembly is complex.

BRIEF DESCRIPTION OF THE INVENTION

The object of the invention is to provide a switching device allowing the above-mentioned problem to be solved. The object of the invention is achieved with a switching device, which is characterized in what is stated in the independent claim. Preferred embodiments of the invention are described in the dependent claims.

The invention is based on providing the switching device with an actuator adapted for driving the main shaft and capable of turning from the 0 position in both directions.

An advantage of the switching device of the invention is a simple structure.

BRIEF DESCRIPTION OF THE FIGURES

In the following, the invention will be described in more detail in connection with preferred embodiments with reference to the accompanying drawings, in which.

DETAILED DESCRIPTION OF THE INVENTION

FIGS. 1 to 4 show the operating mechanism of a switching device according to an embodiment of the invention. The operating mechanism comprises a control shaft 4, an actuator 6, and spring means 7 assembled in a frame 2.

Figure 6:
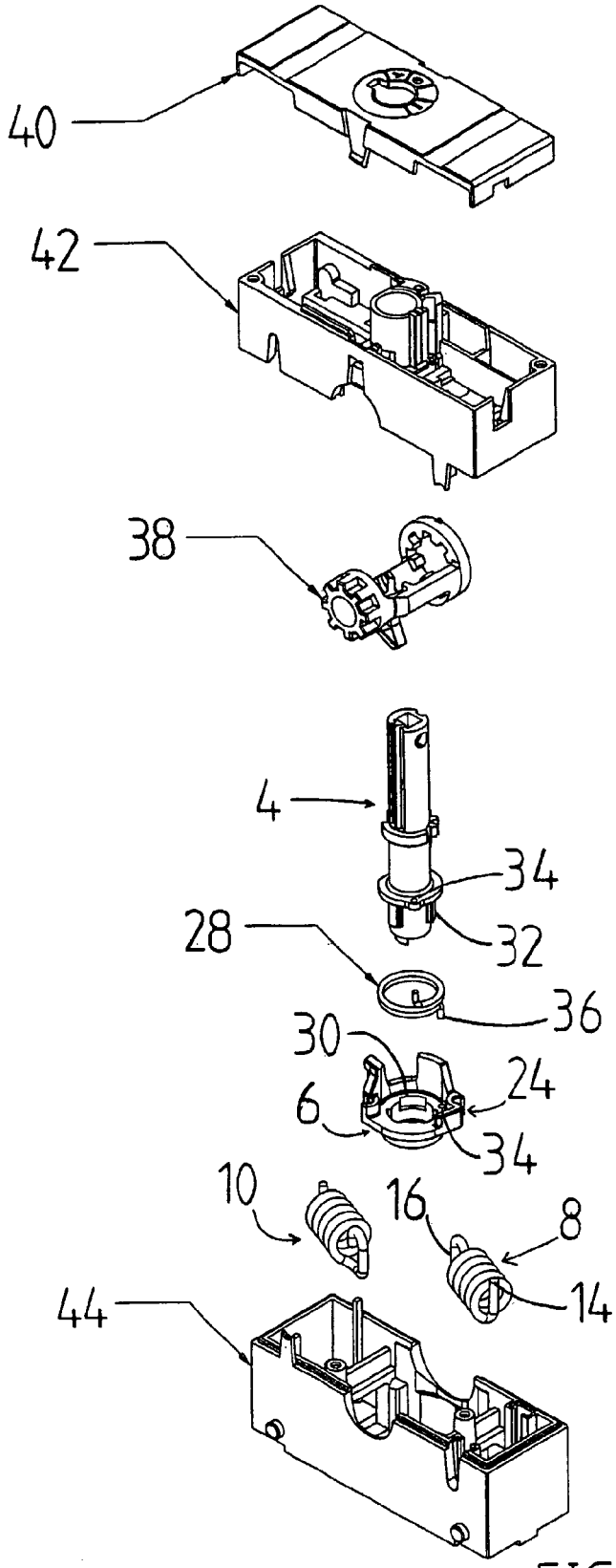
FIG. 6 shows the control device module of FIG. 5 unassembled.

The actuator 6 is rotatable around an axis 12 of rotation and arranged to rotate the main shaft of the switching device. The control shaft 4 is rotatable around the axis 12 of rotation and adapted to rotate the actuator 6. The control shaft 4 is connected to the actuator 6 by connecting means comprising a spiral spring means 28. An example of the implementation of the connecting means is shown in FIG. 6, which will be dealt with later. The spring means 7 comprise two working springs 8 and 10, each having a first end 14 supported rotatable to the frame 2, and a second end 16. The first end 14 of each working spring is thus hinged to the frame 2 in a manner allowing the second end 16 of the working spring to move circumferentially relative to the first end 14. The working springs 8 and 10 are coil springs and they are so rigid that they do not require buckling blocking bars inside thereof.

A switching device whose operating mechanism is shown in FIGS. 1 to 4 has a 0 position, an I position and a testing position. In the 0 position, the poles of the switching device are open and in the I position, the poles of the switching device are closed. In the testing position, the poles of the switching device are open, but the position of the auxiliary contacts corresponds to the I position of the switching device. Both the control shaft 4 and the actuator 6 have a 0 position, an I position and a testing position, which correspond to the aforementioned positions of the switching device.

In a complete switching device assembly, an operating handle (not shown) of the switching device is fastened to the control shaft 4 allowing the user to rotate the control shaft.

Figure 1:
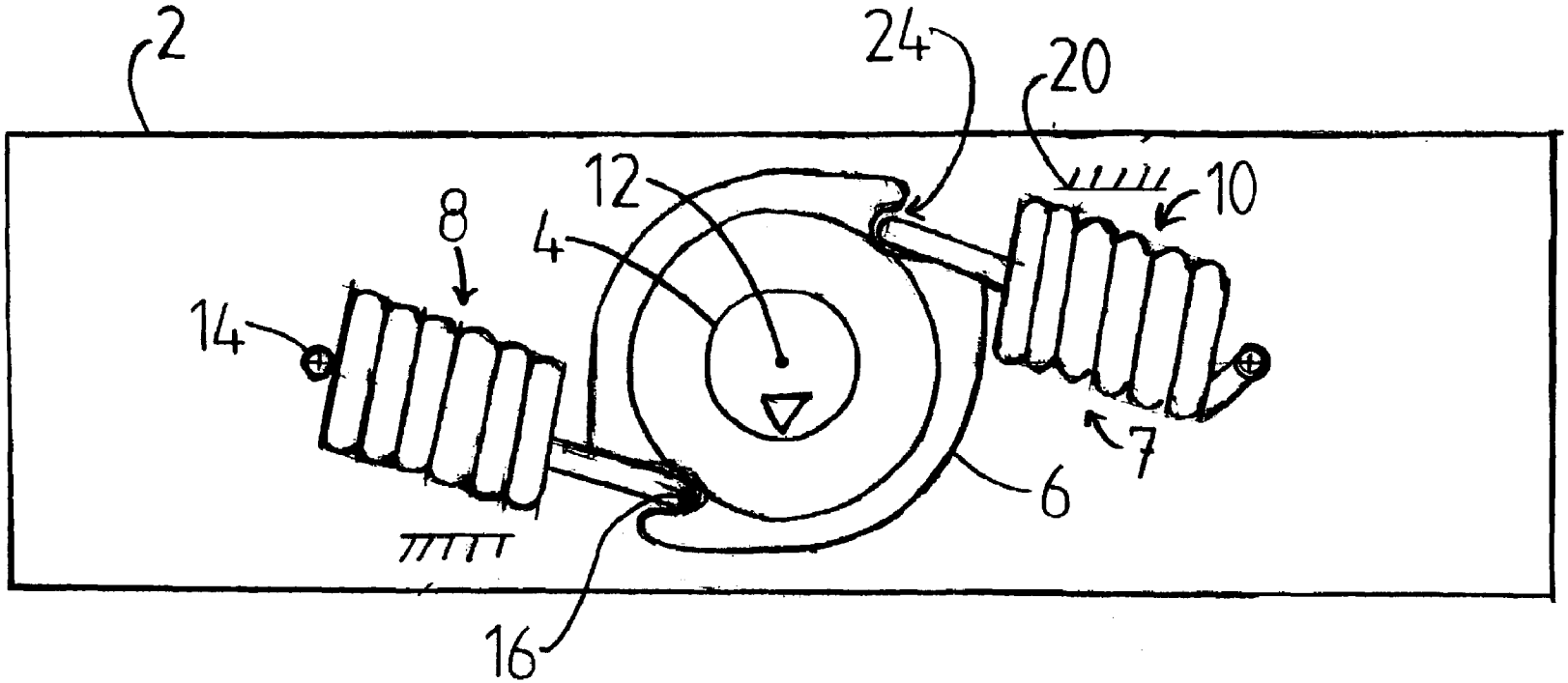
FIG. 1 is a schematic view of the operating mechanism of a switching device according to an embodiment of the invention with the switching device in the 0 position.

In FIG. 1, the control shaft 4 and the actuator 6 are in the 0 position. This being so, both the working springs 8 and 10 and the spiral spring means 28 are substantially in a rest position, and the second end 16 of each working spring is in a corresponding slot 24 of the actuator 6. The second end 16 of each working spring comprises a bar-like portion extending substantially parallel to the axis 12 of rotation, which in FIGS. 1 to 4 is substantially perpendicular relative to the plane of the figure. Each slot 24 is adapted to cooperate with said bar-like portion of the second end of the corresponding working spring.

Figure 2:
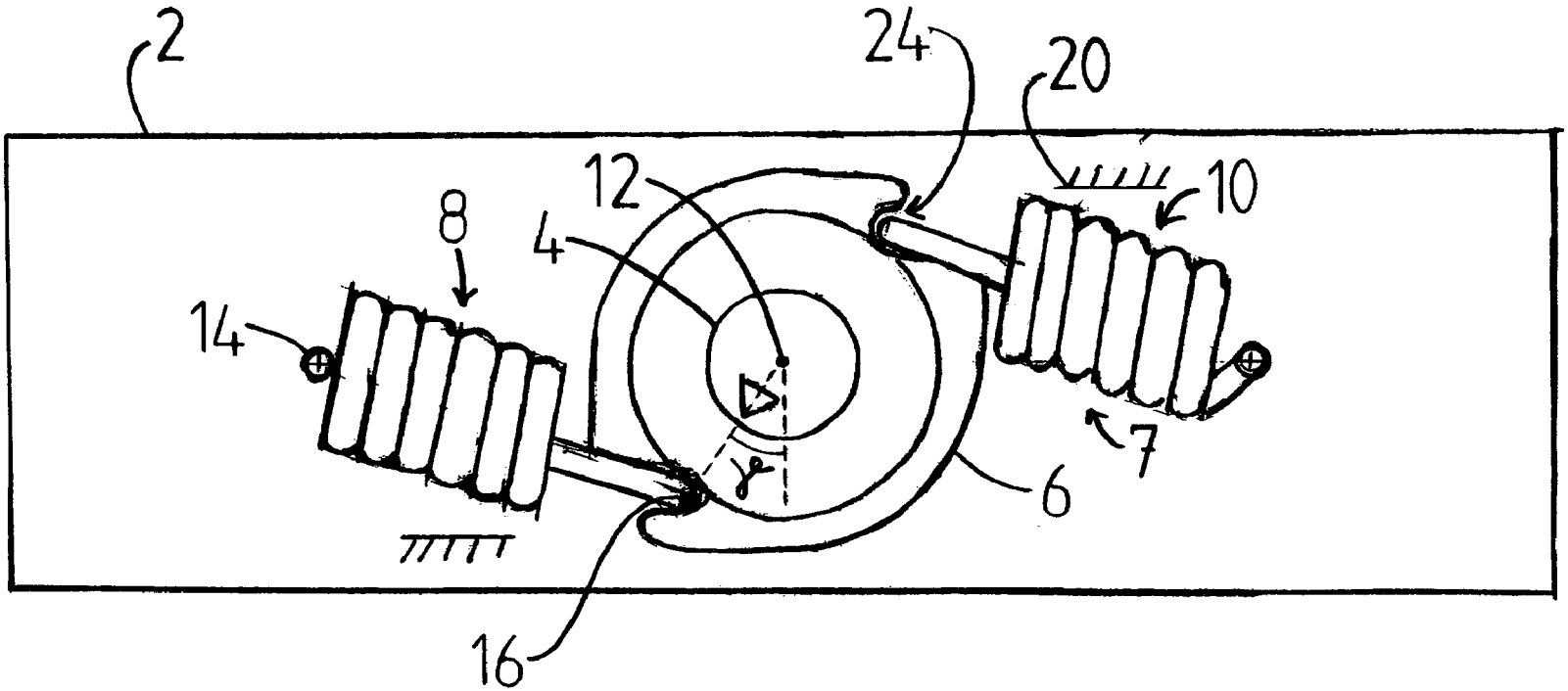
FIG. 2 is a schematic view of the operating mechanism of FIG. 1 with the control shaft turned along its free travel towards the I position.

In FIG. 2, the control shaft 4 is rotated along the free travel, i.e. angle $\gamma$ clockwise compared with its 0 position. This being so, the spiral spring means 28 is tensioned, but the actuator 6 is still in the 0 position. In the embodiment shown in the figures, angle $\gamma$ is 35°.

When the control shaft 4 is further rotated clockwise from the position of FIG. 2, the actuator 6 starts to turn with the control shaft 4, and the working springs 8 and 10 start to become compressed.

Once the actuator 6 has rotated 45° relative to its 0 position, it reaches its first dead point. This being so, the working springs 8 and 10 have reached their highest tension. When the actuator 6 is at the first dead point, the control shaft is at an 80° angle relative to its 0 position.

When the actuator 6 has passed the first dead point, the working springs 8 and 10 start to decompress. Thereby the actuator 6 starts to rotate rapidly clockwise towards the I position, and the tension of the spiral spring means 28 starts to lower, until, when the actuator 6 is at an 80° angle relative to its 0 position, the spiral spring means 28 has reached its rest position and the control shaft 4 starts to rotate along with the actuator 6. Once the actuator 6 has rotated by angle $\alpha_6$ relative to its 0 position, it reaches its I position and stops rotating. This being so, the control shaft 4 is also in its I position, being at angle $\alpha_4$ relative to its 0 position. In the embodiment shown in the figures, both angles $\alpha_4$ and $\alpha_6$ are 90°.

When the actuator 6, rotated by the working springs 8 and 10, starts to rotate the control shaft 4, the control shaft is at an 80° angle relative to its 0 position. In principle, the user experiences a 10° stroke of the operating handle of the switching device, but as the user is turning the handle in exactly the same direction, the stroke is not felt in practice.

Figure 3:
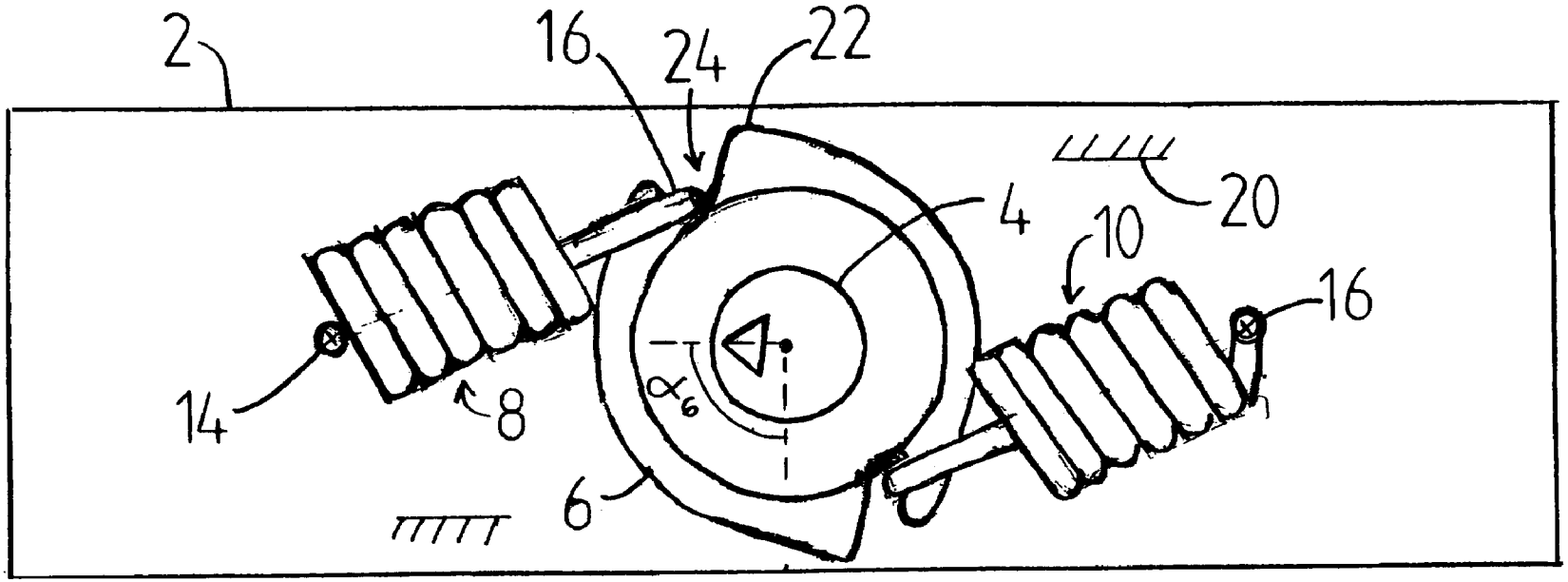
FIG. 3 is a schematic view of the operating mechanism of FIG. 1 with the switching device in the I position.
Figure 4:
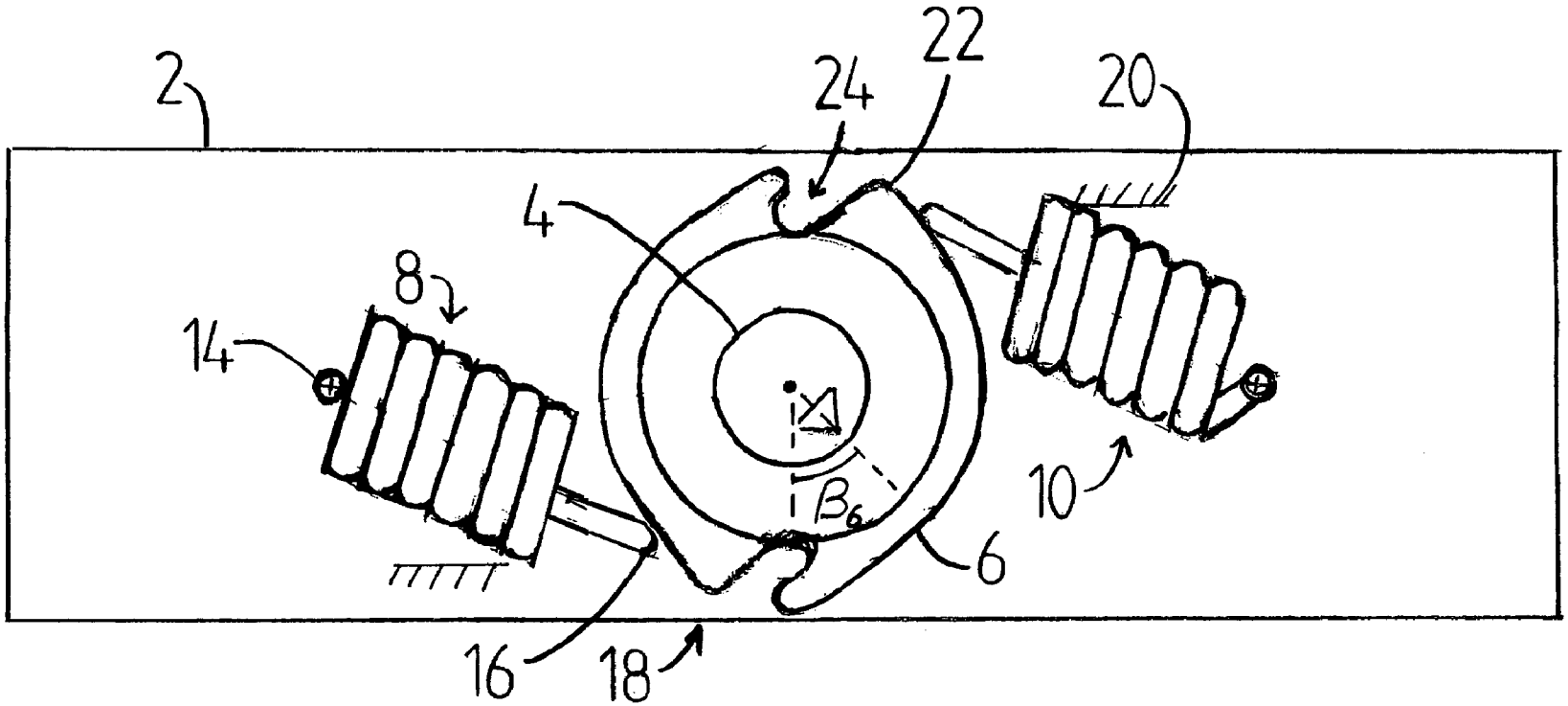
FIG. 4 is a schematic view of the operating mechanism of FIG. 1 with the switching device in the testing position.

In FIG. 3, the control shaft 4 and the actuator 6 are in the I position. As the control shaft 4 starts to be rotated anticlockwise from the position of FIG. 3, the actuator 6 immediately starts to turn with the control shaft 4, and at the same time the working springs 8 and 10 start to be compressed. Once the actuator 6 has been rotated 45° anticlockwise from the position of FIG. 3, it reaches the first dead point. When the actuator 6 is rotated over the first dead point anticlockwise, the working springs start to decompress and rotate the actuator 6 into the 0 position. As the actuator 6 rotates anticlockwise, rotated by the working springs, the spiral spring means 28 is tensioned. Even if the user entirely detached his grip of the operating handle of the switching device immediately after the actuator 6 has passed the first dead point anticlockwise, the spiral spring means 28 also draws the control shaft 4 to its 0 position.

FIGS. 1 to 3 show that the second end 16 of each working spring is in the corresponding slot 24 when the actuator 6 is between its 0 position and I position.

In the embodiment shown in the figures, the working springs 8 and 10 are adapted to operate purely as compression springs when the actuator 6 is between the 0 position and the I position. In other words, the working springs are at no stage stretched longer than their rest position lengths, and they are not subjected to any substantial lateral bending forces.

When the control shaft 4 starts to be rotated anticlockwise from the position of FIG. 1, i.e. the 0 position of the switching device, the actuator 6 immediately starts to rotate along with the control shaft 4. When the actuator 6 is rotated anticlockwise, the working springs 8 and 10 start to bend laterally. The lateral bending of the working springs is caused by bending means 18, which comprise supporting members 20 provided in the frame 2 and bending member 22 provided in the actuator 6. The supporting members 20 are provided by placing the working springs sufficiently close to the walls of the frame 2, whereby said walls operate as supporting members 20. Each bending member 22 provided in the actuator 6 is a cam adjacent to the corresponding slot 24.

When the actuator 6 is rotated anticlockwise from its 0 position, each bending member 22 directs a lateral force to the second end 16 of the corresponding working spring, the force being directed outwards relative to the axis 12 of rotation. When each supporting member 20 provided in the frame 2 simultaneously directs a lateral force to the middle portion of the corresponding working spring, i.e. between the first and second ends of the working spring, the force being reverse relative to the force directed by the bending member 22, each working spring bends laterally. Herein, the lateral direction of a working spring refers to the direction that is perpendicular relative to the axial direction defined by the first end 14 and the second end 16.

When the actuator 6 is rotated sufficiently anticlockwise from the 0 position, it reaches a second dead point. When the actuator 6 is between the 0 position and the second dead point, the spring means 7 tend to rotate the actuator 6 towards the 0 position. When being rotated anticlockwise, the actuator 6 may have a small clearance, whereby the bending means start to bend the working springs laterally only after the actuator has rotated for instance 5° anticlockwise from its 0 position. Other functions of the actuator 6 may also have small clearances. These clearances help to make sure for instance that the spring means 7 are not tensioned at other times than when the operating position of the switching device is being changed. Allowing clearances may also be advantageous in order to facilitate manufacturing.

When the actuator 6 exceeds the second dead point anticlockwise, the second end 16 of each working spring is detached from the corresponding slot 24 because of the lateral bending. The spring means 7, cooperating with the bending means 18, cause the actuator 6 to rotate up to its testing position having passed the second dead point anticlockwise, even if the user detached his grip of the operating handle of the switching device.

When the actuator 6 has rotated by angle $\beta_6$ anticlockwise relative to its 0 position, it reaches its testing position and stops rotating. Hereby also the control shaft 4 is in its testing position, being at angle $\beta_4$ relative to its 0 position. In the embodiment shown in the figures, both angles $\beta_4$ and $\beta_6$ are −45°, the negative sign representing the reverse direction as compared with angles $\alpha_4$, $\alpha_6$ and $\gamma$.

When the actuator 6 is rotated sufficiently clockwise from the testing position, it reaches the second dead point. When the actuator 6 is between the testing position and the second dead point, the spring means 7 tend to rotate the actuator towards the testing position. When the actuator 6 exceeds the second dead point clockwise, the second end 16 of each working spring enters the corresponding slot 24. When the actuator 6 is between the second dead point and the 0 position, the spring means 7 tend to rotate the actuator towards the 0 position, as was previously stated.

When the operating handle of the switching device is released between the 0 position and the testing position of the actuator, the actuator 6 thus tends to move to either the 0 position or the testing position depending on which side of the second dead point the actuator is. The forces directed by the spring means 7 to the actuator 6 between the 0 position and the testing position are generated substantially only from the lateral bending of the working springs, i.e. the working springs are not substantially compressed or stretched axially. The lateral bending of the working springs is achieved by means of the bending means 18 in the above-described manner.

The force required to exceed the dead points can be affected by the design of the spring means 7 and the bending means 18. In an embodiment of the invention, exceeding the second dead point requires less force than does exceeding the first dead point.

Figure 5:
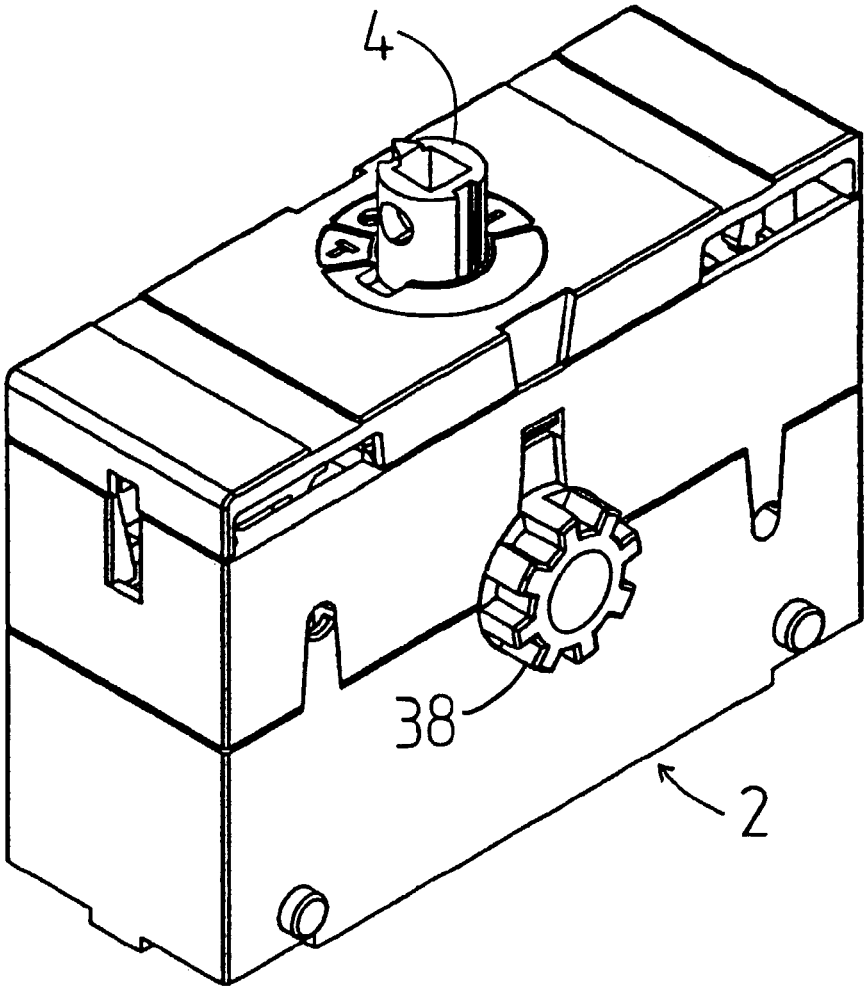
FIG. 5 shows the control device module of a switching device according to an embodiment of the invention seen obliquely from above.

The switching device of the invention may be modular, i.e. comprise a control device module and one or more pole cell modules. FIG. 5 shows the control device module of a modular switching device according to an embodiment of the invention, and FIGS. 6 show the control device module of FIG. 5 disassembled. The control device module shown in FIGS. 5 and 6 operates in the aforementioned manner, which is described in FIGS. 1 to 4.

In FIG. 6, the frame of the control device module is disassembled into a cover portion 40, an upper portion 42 of the frame, and a lower portion 44 of the frame.

FIG. 6 shows that the connecting means for connecting the control shaft 4 and the actuator 6 comprise slits 30 provided in the actuator 6, and corresponding projections 32 provided in the control shaft 4, each of said slits 30 being adapted to receive the corresponding projection 32. The free travel of the connecting means is achieved by arranging the circumferential dimension of each slit 30 to be larger than the circumferential dimension of the corresponding projection 32.

Both the actuator 6 and the control shaft 4 are provided with a hole 34 adapted to receive a peg 36 provided at the corresponding end of the spiral spring means 28.

The working springs 8 and 10 of FIG. 6 comprise a link at the second end 16, the link being an about 270° loop extending substantially in a plane.

The control device module of FIGS. 5 and 6 comprises a main shaft element 38, which in a completed switching device constitutes part of the main shaft, and which is adapted to be rotated by the actuator 6.

It is obvious to a person skilled in the art that the basic idea of the invention can be implemented in a variety of ways. Consequently, the invention and its embodiments are not restricted to the above examples, but can vary within the scope of the claims.

The invention claimed is:

1. A switching device comprising a frame, in which an actuator and a spring means are installed, the actuator being adapted to rotate a main shaft of the switching device and being rotatable around an axis of rotation, the actuator having a 0 position, an I position and a first dead point between the 0 position and the I position, the I position being located by a given angle ($\alpha_6$) in a first direction relative to the 0 position, and the spring means being comprised of one or more working springs each including a first end supported by the frame, and a second end, the spring means rotate the actuator, when the actuator is between the 0 position and the I position, towards the 0 position or the I position depending on which side of said first dead point the actuator is, wherein the actuator also has a testing position, the testing position being located by a predetermined angle ($\beta_6$) in a second direction relative to the 0 position, said second direction being opposite relative to said first direction.

2. A switching device as claimed in claim 1, wherein the actuator has a second dead point between the 0 position and the testing position, the spring means rotates the actuator, when the actuator is between the 0 position and the testing position, towards the 0 position or the testing position depending on which side of said second dead point the actuator is.

3. A switching device as claimed in claim 2, wherein the second dead point is accomplished with bending means bending each of the working springs in a lateral direction.

4. A switching device as claimed in claim 3, wherein the bending means comprise, corresponding to each of the working springs, at least one supporting member provided in the frame, and at least one at least one bending member provided in the actuator in such a manner that said bending member is adapted to direct a lateral force to the second end of the corresponding one of the working springs, and said supporting member is adapted to direct a lateral force between the first end and the second end of the corresponding one of the working spring, the force directed by the supporting member being opposite in direction respective to the force directed by the bending member.

5. A switching device as claimed in claim 4, wherein each of said working springs is a coil spring.

6. A switching device as claimed in claim 3, wherein each of said working springs is a coil spring.

7. A switching device as claimed in claim 2, wherein each of said working springs is a coil spring.

8. A switching device as claimed in claim 7, wherein the first end of each of the working springs is supported rotatable to the frame.

9. A switching device as claimed in claim 8, wherein the actuator comprises, corresponding to each of the working springs, a slot receiving the second end of the corresponding one of the working springs, wherein the second end of each of each of the working springs is at all times in the corresponding slot when the actuator is between its 0 position and I position.

10. A switching device as claimed in claim 9, wherein the switching device comprises a control shaft for rotating the actuator and having a 0 position, an I position and a testing position.

11. A switching device as claimed in claim 10, wherein the control shaft is rotates around said axis of rotation.

12. A switching device as claimed in claim 1, wherein each of said working springs is a coil spring.

13. A switching device as claimed in claim 12, wherein when the actuator is between the 0 position and the I position, each of said working springs acts as a compression spring.

14. A switching device as claimed in claim 1, wherein the first end of each working spring is supported rotatable to the frame.

15. A switching device as claimed in claim 1, wherein the actuator comprises, corresponding to each of the working springs, a slot receiving the second end of each of the working springs, wherein the second end of the corresponding one of the working springs is at all times in the corresponding slot when the actuator is between the 0 position and the I position.

16. A switching device as claimed in claim 15, wherein the switching device is configured such that when the actuator s rotated from the 0 position towards the testing position, the second end of each working springs is detached from the corresponding slot, wherein when the actuator is rotated from the testing position towards the 0 position, the second end of each of the working springs enters the corresponding slot.

17. A switching device as claimed in claim 1, wherein the switching device comprises a control shaft for rotating the actuator and having a 0 position, an I position and a testing position.

18. A switching device as claimed in claim 17, wherein the control shaft is connected to the actuator by means of connecting means, the connecting means having a free travel, the connecting means comprising a spiral spring means.

19. A switching device as claimed in claim 18, wherein the connecting means are adapted such that when the control shaft is rotated from the 0 position in the first direction by an angle ($\gamma$) corresponding to the free travel, the spiral spring means is tensioned while the actuator remains substantially in position, and when the turning angle of the control shaft exceeds the angle ($\gamma$) corresponding to the free travel in the first direction, the actuator rotates along with the control shaft until the actuator reaches the first dead point.

20. A switching device as claimed in claim 1, wherein the control shaft rotates around said axis of rotation.

* * * * *